United States Patent [19]

Olesen

[11] Patent Number: 4,598,852

[45] Date of Patent: Jul. 8, 1986

[54] FASTENER DRIVING TOOL INCLUDING FASTENER DEFORMATION AND GUIDANCE ARRANGEMENTS

[75] Inventor: Paul Olesen, Bellmore, N.Y.

[73] Assignee: Swingline Inc., Long Island City, N.Y.

[21] Appl. No.: 645,471

[22] Filed: Aug. 29, 1984

Related U.S. Application Data

[63] Continuation-in-part of Ser. No. 372,911, Apr. 6, 1982, abandoned.

[51] Int. Cl.[4] ..... B25C 1/06

[52] U.S. Cl. ..... 227/119; 227/120

[58] Field of Search ..... 227/82, 83, 119, 120, 227/149, 156

[56] References Cited

U.S. PATENT DOCUMENTS

| | | | |
|---|---|---|---|
| 525,581 | 9/1894 | Blakey | 227/139 |
| 1,958,739 | 5/1934 | Bliss et al. | 227/83 |
| 2,089,573 | 8/1937 | Polzer . | |
| 2,150,127 | 3/1939 | Passek | 227/83 |
| 2,172,259 | 9/1937 | Posnack | 227/148 X |
| 2,242,967 | 5/1941 | Carlile . | |
| 2,420,258 | 5/1947 | Maynard | 227/83 |
| 4,136,810 | 1/1979 | Bull | 227/120 |
| 4,206,863 | 6/1980 | Savino | 227/120 X |
| 4,225,075 | 9/1980 | Chi | 227/119 |
| 4,328,918 | 5/1982 | Yoshida | 227/120 X |

FOREIGN PATENT DOCUMENTS

| | | | |
|---|---|---|---|
| EPA0008749 | 3/1980 | European Pat. Off. . | |
| 879536 | 6/1953 | Fed. Rep. of Germany | 227/119 |

*Primary Examiner*—Paul A. Bell

*Attorney, Agent, or Firm*—Pennie & Edmonds

[57] ABSTRACT

A portable fastener driving tool (10) having a raceway (26) with driver blade (21, 60) reciprocating therein from a retracted position to a fastener-driven position for driving fastener (33, 61) seriatim from a fastenerstick (19, 62) positioned at an angle to the raceway. The first-to-be-driven fastener (33, 61), while attached to the stick (19, 62), is positioned in raceway (26) so that descending blade (21, 60) serves to orient the fastener (33, 61) to a position substantially parallel to the raceway (26) for driving down and out the raceway into the workpiece. Ramp means (37, 46) which form part of tool exit opening (38) re-orients fastener (33) as necessary and guides it during its exit. The fastenerstick (19, 62) may be supported in raceway (26) by detent stud means (29, 31) which retract from the raceway (26) when staple (33, 61) descends.

10 Claims, 11 Drawing Figures

FASTENER DRIVING TOOL INCLUDING FASTENER DEFORMATION AND GUIDANCE ARRANGEMENTS

RELATED APPLICATION

This is a continuation-in-part of U.S. patent application Ser. No. 372,911 filed Apr. 6, 1982 entitled "Fastener Driving Tool For Corners", now abandoned.

TECHNICAL FIELD

This invention relates to portable fastener driving tools in which fasteners in a fastenerstick form are mounted on a rail and in which the first-to-be-driven fastener is deformed as and after its removal from the stick to permit the rail to guide such fastener during its travel to and into the workpiece.

This invention also relates to portable fastener driving tools which drive fasteners seriatim using a reciprocating blade and include a magazine housing lower surface which is held against the workpiece during operation and, in particular, to a portable fastener driving tool having a fastenerstick magazine lower surface positioned at an acute angle to the plane of movement of the reciprocating blade to permit the tool to be positioned for driving in heretofore inaccessible corners or other areas.

BACKGROUND ART

The guidance arrangements of fasteners removed from the fastenerstick (and initially being moved by the fastener driver) has included the remaining fasteners in fastenerstick form as positioned on the rail and various attachments to the rail which attachments have required cumbersome and laborious attachment and removal for each selected fastener size driven.

Arrangements for positioning fastener magazines parallel to or at acute angles to the driving blade have been suggested for some years; U.S. Pat. Nos. 371,659 to Arnold; 525,581 to Blakey and 2,966,681 to Campbell.

U.S. Pat. No. 2,086,922 to Peterson teaches use of a staplestick magazine positioned generally parallel to the driver blade with an arrangement of reciprocating parts to remove seriatim staples from the staplestick and thereafter transport and orient them for driving.

U.S. Pat. No. 2,396,356 to Wickens meters individual staples down a rail at an acute angle to the drive blade.

None of the prior arrangements for feeding fasteners seriatim and driving them have been satisfactory from the point of view of reliability and simplicity.

SUMMARY OF THE INVENTION

Broadly, the invention comprises a portable fastener driving tool having a reciprocating driver blade and a fastener magazine in which the fastenerstick is positioned on a rail having a front face which fastenerstick is perpendicular to or at an acute angle to the plane in which the driver blade reciprocates. One end of the fastenerstick abuts the fastener raceway with the first-to-be-driven fastener positioned at an angle to the driver blade. The first-to-be-driven fastener is sheared from the fastenerstick by the force of the driver blade. Upon continued movement of the fastener, it is guided by the rail face and then, as necessary, by inclined fastener ramps adjacent the exit opening of the tool urge the fastener back into the raceway, if it has moved out of the raceway, to assure proper alignment of the fastener as the fastener exits the tool. Fastener ramps, together with the raceway define an exit opening which guides the full length of the fastener as it moves through the opening into the workpiece.

It is a feature that the driver blade may be recessed to deform the first-to-be-driven fastener in such a way that leg portions of the fastener are caused to move to positions in front of the rail face to provide increased and improved guidance of the fastener by the rail.

It is a feature that a retractable detent may be positioned in the raceway which detent serves to assist in orienting the first-to-be-driven fastener as the blade strikes and moves such fastener during the driving stroke and also serves to support the fastenerstick during loading of the magazine. A retractable detent is not required when driving fasteners having heads or crowns which are wide or otherwise shaped so that the driver blade striking them will properly orient them; however, with fasteners which are not properly oriented by the driver blade a detent is required.

It is also a feature that more than one detent may be used. Additional detents are positioned below the detent shown in the drawings and operate in the same manner to re-orient as necessary the fastener as it moves down the raceway.

BEST MODE FOR CARRYING OUT INVENTION

Figure 1:
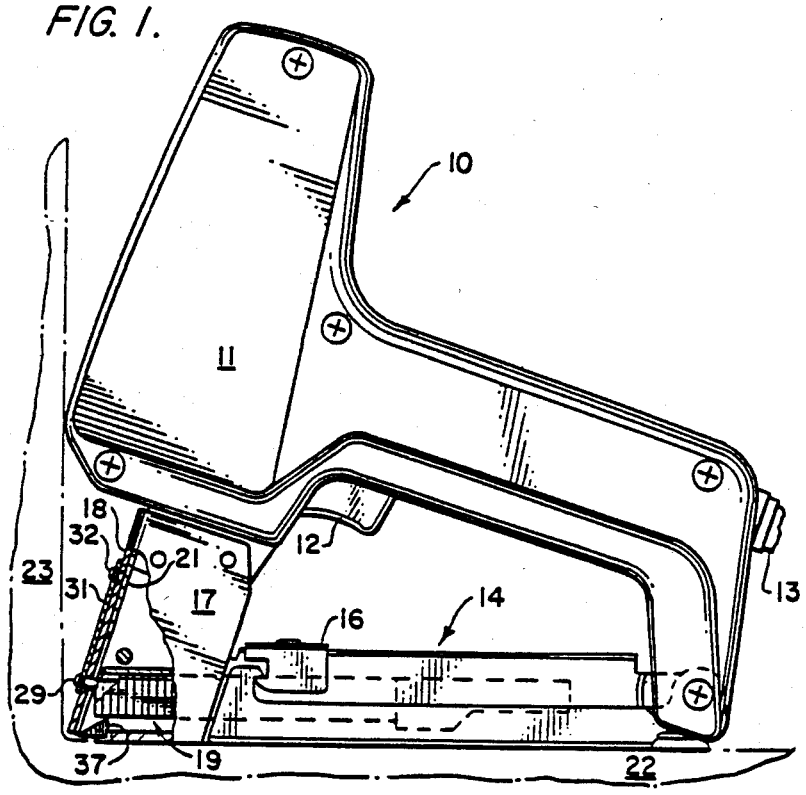
FIG. 1 is a side elevational view of the staple driving unit partially broken away.

In FIGS. 1–4, electrically powered staple driving tool 10 includes housing 11, trigger 12, electrical power conduit 13, staple magazine 14. Latch 16 permits access to magazine for loading and unloading staplesticks. Below housing 10 is a lower drive frame 17 which carries front sheath 18. Also shown is driver blade 21 and a staplestick 19 riding on rail 24 being urged toward and against staple raceway 26 by magazine spring means (in dashed lines in FIG. 1). Rail 24 has a sloping front which parallels raceway 26. Tool 10 is shown positioned in a 90° corner formed by a floor 22 and a vertical wall 23. The configuration of housing 10 and the angle of the magazine 14 to driver blade 21 permits driving staples in the corner.

Driver blade 21 reciprocates in staple raceway 26 formed in front sheath 18 using an electric solenoid and suitable blade return mechanism such as spring means (not shown). The front face 27 of sheath 18 has an aperture in it for receiving detent stud 29.

Detent stud 29 is positioned in staple raceway 26 adjacent the first-to-be-driven staple 33 of staplestick 19. Stud 29 may be positioned below and tangent to the crown 39 of the staple 33, as shown in the drawings, or may be positioned in a slightly lower position. To assure that staple 33 exits the tool and enters the workpiece in proper orientation, inclined ramps 37 are positioned adjacent to exit 38 of raceway 26. If staple 33 strays out of raceway 26 during the driving stroke ramps 37 urge it back into proper alignment. Ramps 37 also cooperate with raceway 26 to form exit 38 which exit guides and orients staple 33 as its full length passes through the exit.

Figure 5:
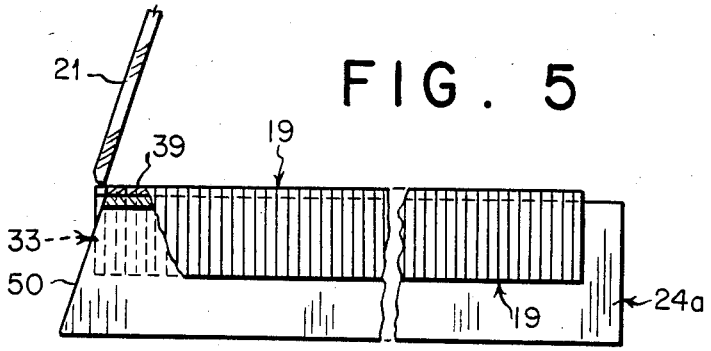
FIG. 5 is a partial side elevational view showing a first alternative embodiment in which the rail has a sloping front face.
Figure 6:
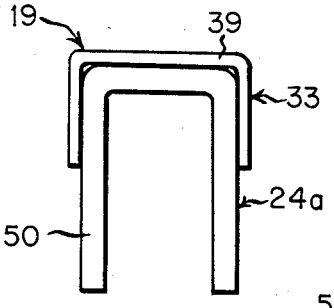
FIG. 6 is a front view of the fastenerstick on the rail as shown in the first alternative embodiment.
Figure 7:
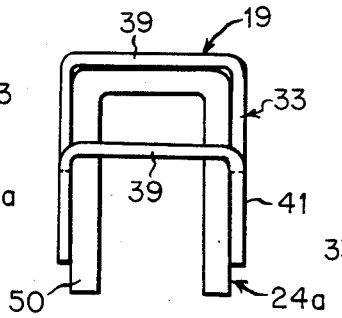
FIG. 7 is, in the first alternative embodiment, a front view of the fastenerstick on the rail and the first-to-be-driven fastener in front of the rail.

Turning to FIGS. 5, 6, and 7, an alternative rail **24*a* is shown which has a sloping front surface 50 which assists in guiding the crown 39 of staple 33 as staple 33 is sheared off the staplestick 19 and descends under the force of driver blade 21. Rail 24*a* has a depth to accommodate staples having varying leg lengths including staples with much longer legs than staple 33**.

Figure 8:
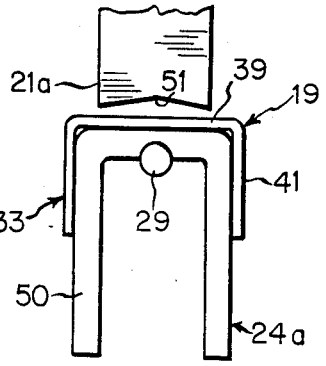
FIG. 8 is a front elevational view of the first alternative embodiment showing a modified driver to accomplish distortion of the fastener.
Figure 9:
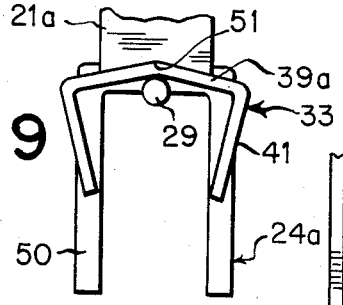
FIG. 9 is a front elevational view similar to FIG. 8 showing the blade distorting the fastener.

To attain further guidance of staple 33 during its descent past the front surface 50 of rail **24*a*, staple 33 is deformed by blade 21*a* which has recess 51 in its end portion (FIG. 8). When the blade 21*a* with its recess 51 strikes staple 33, and strikes against stud 29, staple 33 is deformed creating a bent crown 39*a* and, in turn, causing the staple legs 41 to toe in so that a portion of one or both legs 41 is moved in front of sloping surface 50. As deformed staple 33 is guided by the rail surface 50 during its descent. Stud 29 assists in the deformation of staple 33. Staple leg or legs 41** may be bent at any desired angle provided they are readily driveable through the workpiece and are capable of being clinched, if desired.

Figure 10:
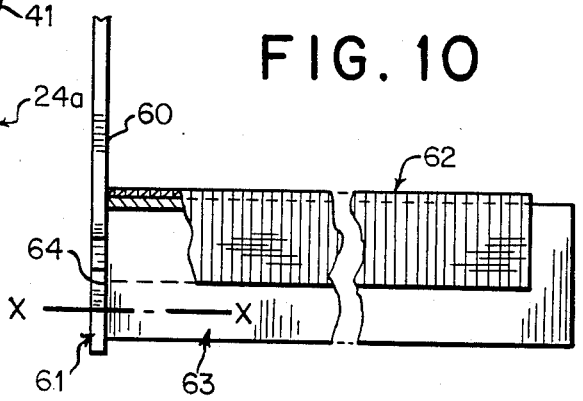
FIG. 10 is a partial side elevational view of a second alternative embodiment in which the rail front is perpendicular to the axis of the rail.
Figure 11:
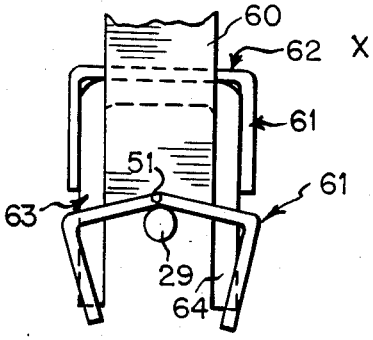
FIG. 11 is a front view of the rail, fastenerstick and rail of the second alternative embodiment showing the fastener as distorted by the driver.

Directing attention now to FIGS. 10 and 11, it is seen that employing a recessed blade 60 permits improved guidance of the staple 61 as and after it is stripped from a staplestick 62 positioned on a standard rail 63. Rail 63 has a front face 64 which is perpendicular to the axis x—x of rail 63 and the blade 60 reciprocates perpendicular to such axis. As noted above, guidance of the legs of lead (first-to-be-driven) staple 60 to prevent them from swinging in a direction opposite to the direction of advance of stick 62 is accomplished by stick 62 for as long as the staple 63 is adjacent stick 62. Rail 63 has a face 64 extending substantially below stick 62 (as is often the case to accommodate staples of varying leg lengths; see FIG. 11). There is no means for guiding undistorted staples during this portion of its travel. By bending the legs of the staple, in accordance with this invention, the rail face 64 provides this additional guidance to the staple thus avoiding jamming and misfires.

Figure 2:
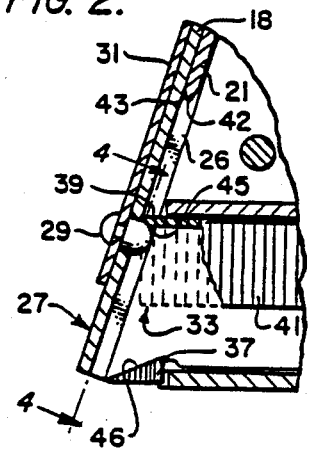
FIG. 2 is an enlarged side view partially broken away to show a portion of the internal mechanism.

In the operation of the staple driving tool 10, magazine 14 is opened and staplestick 19 inserted for urging (to the left as shown in FIG. 1) by spring 25 toward and against raceway 26. Due to the angle between staplestick 19 and raceway 26 and the force of spring 25, the end of stick 19 is urged downwardly against stud 29. If stud 29 is not used in the tool other means for holding staplestick 19 in contact with raceway 26 are required. As driver blade 21 descends staple 33 is removed from staplestick 19; oriented in raceway 26 and driven in the following manner: Staplestick 19 having staple 33 at its left hand end (as shown in FIG. 2) abuts raceway 26 with the crown 39 of staple 33 adjacent stud 29. As drive-blade 21 descends during the driving storke staple crown 39 is hit by blade 21 breaking staple 33 from stick 19 and causing the legs 41 of staple 33 to rotate clockwise toward the raceway 26. The rotational orientation of staple 33 is caused by forces between blade end 42 and the staple crown 39 whose planar surfaces produce the desired rotation. If stud 29 is employed the surfaces of all three co-act to accomplish orientation during the driving stroke. Where a second detent is used, driver blade 21 moves staple 33 down the raceway 26 until staple 33 hits a lower detent whereupon staple 33 will similarly be oriented back into raceway 26 if the staple has, in part, moved out of raceway 26. Retractable detent 29 is caused to retract by staple 33 pushing it out of raceway 26. Blade 21 holds the detent 29 retracted until it returns to its up position. Blade 21 carries chamfer 43 on its lower end to assist in readily retracting detent 29 when the driving stroke is accomplished with no staples in the tool.

Figure 3:
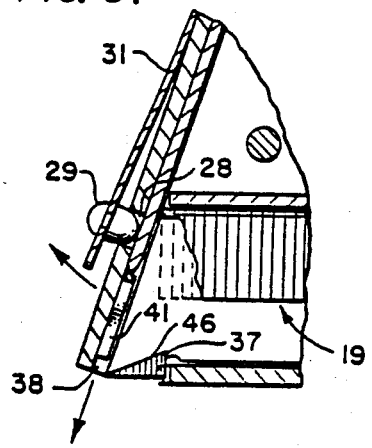
FIG. 3 is another enlarged side view broken away to show the mechanism of FIG. 2 in another stage of its operation.
Figure 4:
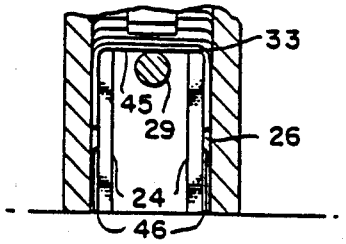
FIG. 4 is a sectional view along lines 4—4 of FIG. 2.

After its rotation into raceway 26, staple 33 continues to descend as shown in FIG. 3 and finally staple 33 is driven out of exit 38 into the workpiece. Ramps 37 provide further guiding, as necessary, of staple 33 toward the raceway 26 in the area adjacent exit 38 when staple legs 41 engage and ride down ramp surfaces 46. Exit 38, defined in part by the end of ramps 46, guides staple 33 during its exit from the tool into the workpiece. As the staple moves down to and through exit opening 38, crown 39 of staple 33 is guided continuously by raceway 26 on one side and by the sloping front of rail 24 on the other side. Legs 42 are guided during the exit of staple 33 by the ends of ramps 37.

The length of raceway 26 and spacing between where driver blade 21 first strikes staple 33 and ramps 37 permits tool 10 to drive staples having longer legs than those shown in FIGS. 2 and 3.

I claim:

1. A portable driving tool in which staples, each having a crown and two (2) legs are driven along a staple driving raceway by a reciprocating driver blade out an exit opening into workpiece, the driving blade lying in a plane and in which each staple is fed from a staplestick positioned on a staple holding rail of a reloadable magazine into the raceway the improvement comprising (a) staplestick feed means for feeding the staplestick including a first-to-be-driven staple and following staples each staple having a crown which crowns lie substantially in a plane such staplestick crown plane being at an angle less than 90° to the driving blade plane; and (b) fastener orientation means for orienting staples from one position as attached to the staplestick to a second position in the blade plane in the raceway as and after it is removed from the staplestick, said orientation means including the (i) driver blade end;

(ii) magazine guide means;

(iii) detent stud means positioned in and retractable from the raceway as the staple is driven along the raceway; and (iv) a crown portion of the staple as struck by the blade whereby the driver blade end strikes the staple crown portion against the stud means to orient the staple and thereafter drive the staple along the raceway past the stud means as it retracts.

2. The portable driving tool of claim 1 in which the crown plane is at an acute angle to the blade plane.

3. The portable driving tool of claim 1 in which the crown plane is perpendicular to the blade plane.

4. The driving tool of claim 1 in which such stud means is mounted on spring mounting means which mounting means holds the stud in the raceway when the blade is in its retracted position and permits the first-to-be-driven staple to push the stud out of the raceway as the blade descends during the driving stroke.

5. The driving tool of claim 1 in which the driver blade end has a surface substantially perpendicular to its longitudinal axis, the staple has a crown surface substantially perpendicular to the axis of the staple legs and the stud means positioned so that during the driving stroke the blade strikes the first-to-be-driven staple crown to shear it from the stick and to orient it in the raceway substantially parallel to the direction of movement of the blade in the raceway.

6. The driving tool of claim 1 in which the driver blade has a recessed end surface for deforming in cooperation with the detent stud means the staple crown and legs to toe in to an extent that the legs move in front of the holding rail.

7. A portable staple driving tool in which staples each having a crown and two legs and are driven along a staple driving raceway by reciprocating staple driver blade out an exit opening into a workpiece and in which each staple is fed from a staplestick into the raceway the improvement comprising (a) positioning staplers in staplestick form with the staple crowns lying substantially in a plane on a magazine rail which rail has a front guide surface adjacent the raceway;

(b) staplestick feed means for feeding a staplestick along the raceway including a first-to-be driven staple;

(c) detent stud means protruding into the raceway and retractable from the raceway as the staple is driven; and (d) a recess in the staple driver blade end for striking the staple against the stud means to deform the staple including its crown to toe in a leg as the staple is removed from the staplestick by the blade end.

8. The tool of claim 7 having in addition spring mounting means mounting the stud means in the raceway which mounting means holds the stud in the raceway when the blade is in its retracted position and permits the first-to-be-driven staple to be distorted and thereafter to push the stud out of the raceway as it descends during the driving stroke.

9. The tool of claim 7 in which the recess in the staple driver blade end consists of the surfaces interseting at the central portion of the blade.

10. The tool of claim 7 in which the rail is capable of accommodating a plurality of staplesticks each stick having staples of a selected length wherein the staples having legs shorter than the rail depth are guided by the rail front guide surface as they are driven downwardly.

* * * * *